US005536052A

United States Patent [19]

Maier

[11] Patent Number: 5,536,052

[45] Date of Patent: Jul. 16, 1996

[54] SASH LOCK WITH IMPROVED TUMBLER

[75] Inventor: Robert G. Maier, Hudson, Ohio

[73] Assignee: Ro-Mai Industries, Inc., Twinsburg, Ohio

[21] Appl. No.: 317,712

[22] Filed: Oct. 4, 1994

[51] Int. Cl.[6] ..... E05C 5/00

[52] U.S. Cl. ..... 292/63; 292/338; 292/DIG. 47

[58] Field of Search ..... 292/338, 339, 292/DIG. 47, DIG. 15, 63, 67

[56] References Cited

U.S. PATENT DOCUMENTS

| | | | |
|---|---|---|---|
| 417,868 | 12/1889 | Janes . | |
| 614,741 | 11/1998 | Moore . | |
| 1,946,833 | 2/1934 | Brown | 292/228 |
| 4,824,154 | 4/1989 | Simpson | 292/338 |
| 4,895,403 | 1/1990 | Osenkowski | 292/336.3 |
| 4,923,230 | 5/1990 | Simpson | 292/67 |
| 5,248,174 | 9/1993 | Matz et al. | 292/388 |

*Primary Examiner*—Steven N. Meyers
*Assistant Examiner*—Monica E. Millner
*Attorney, Agent, or Firm*—Pearne, Gordon, McCoy & Granger

[57] ABSTRACT

A tumbler is pivotably mounted in a sash lock housing. In an extended position, an end of the tumbler limits movement of a window sash. A post in the housing extends through an eccentric bore in the tumbler. The bore defines a shelf or protrusion that urges the tumbler into engagement with the housing, thereby preventing over-rotation of the tumbler in the extended position. A spring urges the tumbler toward the extended position and cooperates with the protrusion to urge the tumbler into engagement with the housing.

15 Claims, 2 Drawing Sheets

22
20
56
54
44
24
34
68
74
28
72
38
70
52
62
32
60
30
26
64
58
56
20
54
44

22
20
44
78
76
80
24
52
70
74
66
38
72
34
62
5
5
32
64
60
58
20

10
20
3
22
3
14
12
20
18
16

SASH LOCK WITH IMPROVED TUMBLER

BACKGROUND OF THE INVENTION

1. Field of the Invention

This invention relates generally to the field of window assemblies and specifically to an improved sash lock for limiting movement of a window sash.

2. Description of the Related Art

Double hung windows are one of the most popular types of windows for residential and other structures. A lower sash is usually disposed immediately inwardly of a upper sash so that the sashes overlap and slide parallel to each other in a window frame.

In order to limit relative movement of the sashes, a stop or limit device known as a "sash lock" has been used. Sash locks have many configurations, but typically include a tumbler pivotably disposed in a housing mounted in a stile of the upper sash. A spring urges the tumbler toward an extended position where the tumbler is engageable with the header rail of the lower sash to limit movement thereof. An upper rear surface of the tumbler engages a back wall of the housing to limit rotation of the tumbler. Examples of sash locks are shown in U.S. Pat. Nos. 417,868 to Janes; 614,741 to Moore, Jr.; 1,946,833 to Brown; 4,824,154 to Simpson; 4,923,230 to Simpson; and 5,248,174 to Matz.

Over-rotation of the tumbler has been a problem with sash locks. In some circumstances, the lower sash or the user may engage the tumbler in such a way that it does not properly engage the back wall of the housing. Thus, the tumbler may over-rotate and cannot adequately limit movement of lower sash. The present invention seeks to solve this problem and others in a simple, easily manufactured assembly.

SUMMARY OF THE INVENTION

The present invention provides an improved sash lock. A housing defines a cavity having a tumbler disposed in the cavity. The tumbler is pivotably mounted so as to permit pivoting movement of the tumbler between a retracted position in the housing and an extended position projecting from the housing. The sash lock is provided with means for urging the tumbler longitudinally into engagement with the housing and means for biasing the tumbler toward the extended position.

The tumbler has a nose projecting from the housing in the extended position and adapted to engage a window sash. A surface of the tumbler is adapted for engaging a back wall of the housing in the extended position. The tumbler is pivotably mounted on a pivot post. The pivot post and housing cooperate to limit rotation of the tumbler.

An eccentric pivot bore into which the pivot post extends cooperates with the pivot post to urge the tumbler into engagement with the housing in the extended position thereby limiting rotation of the tumbler. The pivot bore includes upper and lower recesses separated by a protrusion, said pivot post nesting in the lower recess in the extended position. The lower recess has a radius corresponding to a radius of the pivot post. The protrusion engages the pivot post and resists longitudinal movement of the tumbler in the extended position. The means for biasing the tumbler toward the extended position comprises a spring cooperating with the pivot bore to urge the tumbler longitudinally into engagement with the housing. The spring is mounted in a channel in the tumbler and retained by a keeper in the channel.

In one embodiment, the sash lock includes a housing defining a cavity and having a post disposed therein. A tumbler has a sash engaging nose and an eccentric pivot bore therethrough. The tumbler is disposed in the cavity and pivotably mounted on the post so as to permit pivoting movement of the tumbler between a retracted position in the housing and an extended position wherein said nose projects from the housing. A spring urges the tumbler toward the extended position and a protrusion defined by the bore is engageable with the post and cooperates with the spring to urge the tumbler longitudinally into engagement with the housing in the extended position.

The protrusion separates a upper and lower recesses of the bore and the protrusion retains the post in the lower recess in the extended position. An end of the tumbler engages a back wall of the housing and cooperates with the pivot post to limit rotation of the tumbler in the extended position. The end of the tumbler includes a bevel. A cover is mountable on the housing and has the pivot post extending therefrom.

The invention also includes a window assembly having an upper sash and a lower sash, each having a header rail, a base rail, and a pair of stiles. The sash lock described above is disposed in one of the stiles of the upper sash.

DESCRIPTION OF THE PREFERRED EMBODIMENTS

Figure 1:
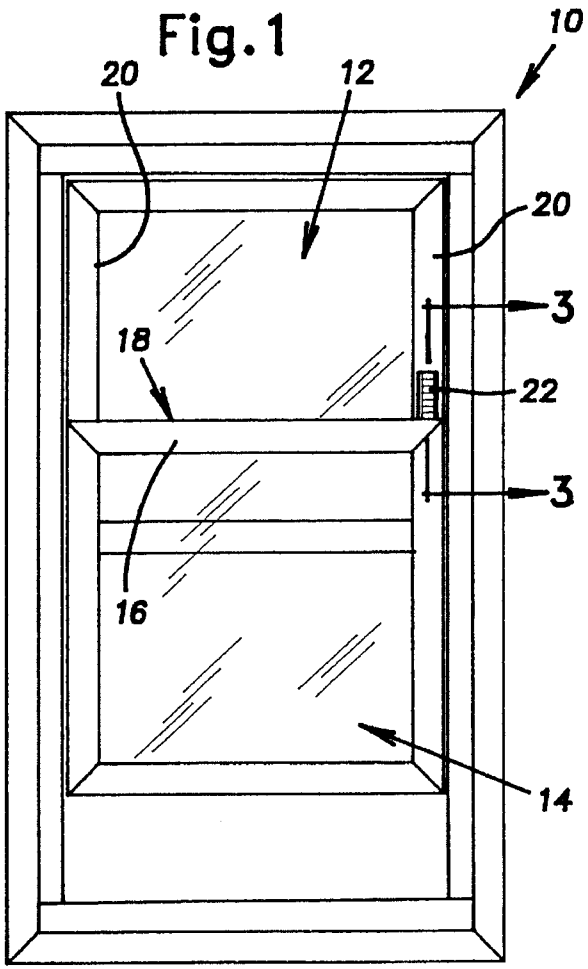
FIG. 1 shows a window assembly according to the present invention, including a sash lock.

Referring to FIG. 1, a double hung window 10 includes an upper sash 12 and a lower sash 14. The lower sash 14 includes a header rail 16 having an upper surface 18. The upper sash includes a pair of stiles 20. The stiles 20 are preferably a hollow plastic construction, but may be wood or metal or a solid construction. A sash lock 22 is mounted in at least one of the stiles 20.

Figure 3:
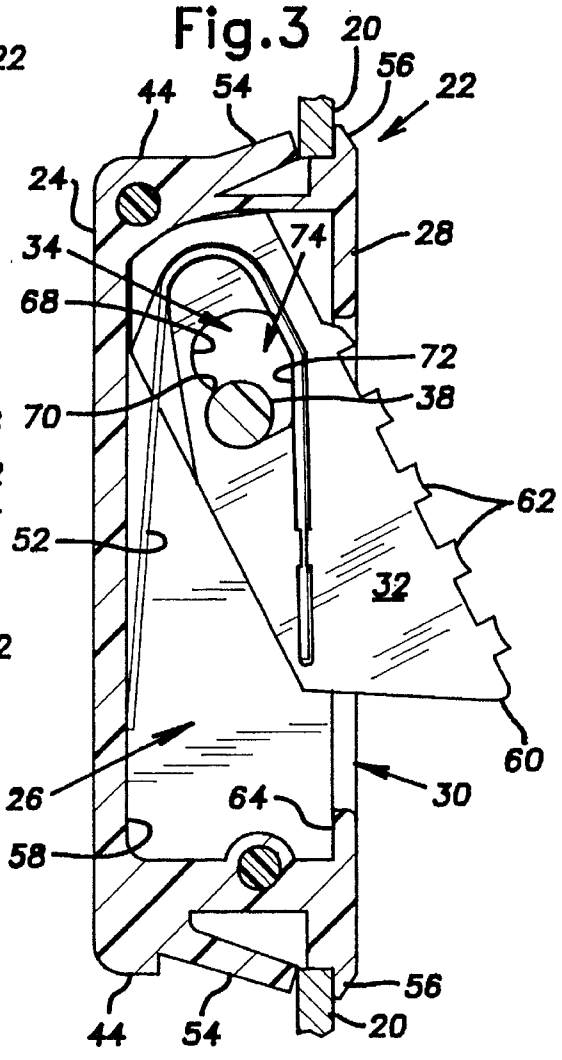
FIG. 3 shows an elevational side view in section of the sash lock in an extended position taken from line 3—3 of FIG. 1.
Figure 2:
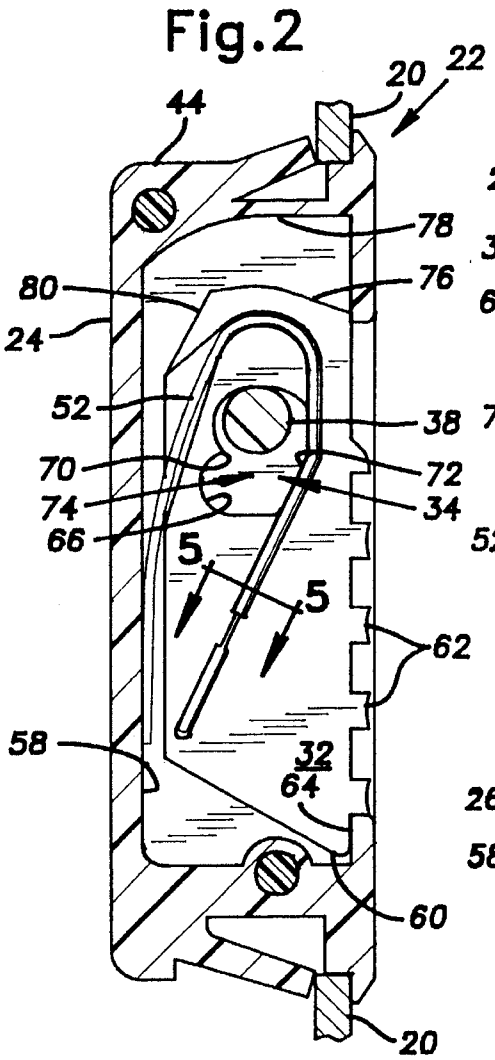
FIG. 2 shows an elevational side view in section of the sash lock in a retracted position.
Figure 4:
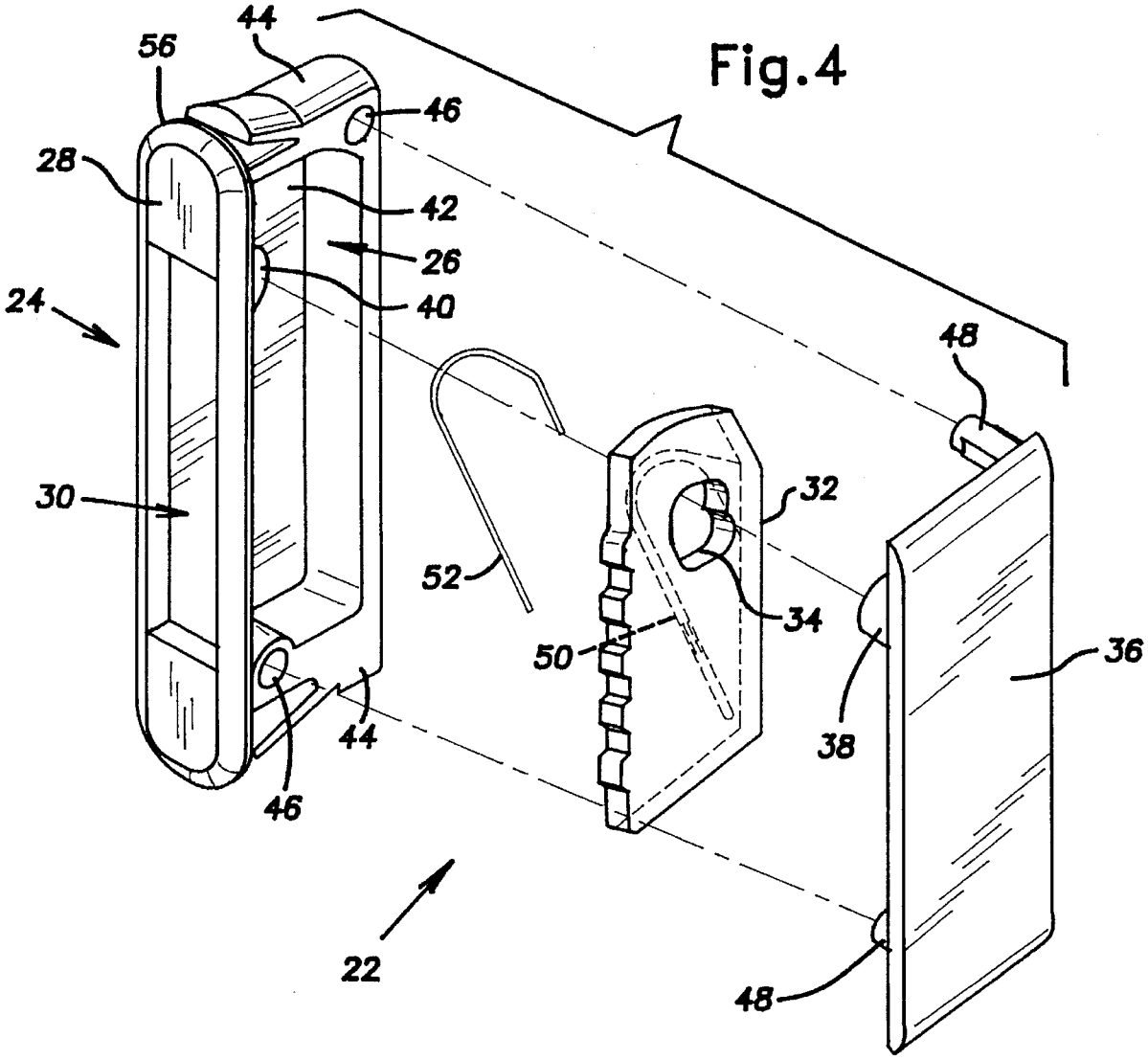
FIG. 4 shows an exploded view of the sash lock.

Referring to FIGS. 2, 3, and 4, the sash lock 22 includes a housing 24 made of plastic or another sturdy and light-weight material. The housing is hollow and defines a cavity 26. A front face 28 has an opening 30 therethrough in communication with the cavity 26.

Figure 5:
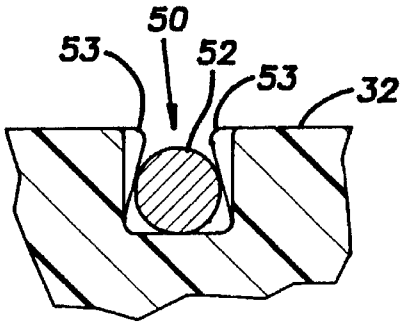
FIG. 5 shows a sectional view of spring retainer taken from line 5—5 of FIG. 2.

A tumbler 32 having a pivot bore 34 is disposed in the cavity 26 and is retained therein by a cover 36. The cover includes a pivot post 38 extending through the pivot bore 34 and nesting in a recess 40 or aperture in a side wall 42 of the housing 24. Upper and lower end walls 44 of the housing 24 each have mounting bores 46 therein adapted to receive mounting posts 48 projecting from the cover 36. The mounting posts 48 snugly receive the mounting bores 46 to hold the cover 36 on the housing 24. The tumbler 32 is provided with a channel 50 for receiving a wire spring 52. As shown in FIGS. 2 and 5, the spring 52 is retained in the channel 50 by a pair of projecting spring retainers or keepers 53 to provide a snap fit. Variations of the spring shown would be also suitable, including a leaf spring, coil spring, an integral flexing member or other device for biasing the tumbler 32.

As shown in FIGS. 2 and 3, flexible housing retainers 54 extend from the end walls 44 of the housing 24. The housing retainers 54 cooperate with a flange 56 around the front face 28 of the housing 24 to retain the housing 24 in the stile 20.

The spring 52 engages a back wall 58 of the housing 24 to bias the tumbler 32 toward the opening 30. In an extended position, shown in FIG. 3, a nose 60 of the tumbler 32 projects through the opening 30 and is adapted to engage the upper surface 18 of the lower sash 14. Ridges 62 are provided to enable an operator to push the tumbler 32 into a retracted position, shown in FIG. 2, and slide the tumbler longitudinally downwardly so that the nose 60 seats behind an inner flange 64 of the front face 28.

The pivot bore 34 has an eccentric shape including a lower radius 66 or recess and an upper radius 68 or recess intersecting at a protrusion 70. The lower and upper radii 66, 68 correspond to the radius of the pivot post 38 to permit nesting of the pivot post therein. The upper radius 68 is preferably slightly larger than the lower radius 66. A front wall 72 of the pivot bore 34 is spaced from the protrusion 70 to define a passage 74 therebetween. The passage 74 is adapted to permit the pivot post 38 to pass therethrough. The pivot bore 34, pivot post 38, inner flange 64, and nose 60 are sized and positioned so that the pivot post nests in the lower radius 66 when the tumbler 32 is extended. That is, the nose 60 clears the inner flange 64 after the center of the pivot post 38 has passed the protrusion 70.

When the tumbler 32 is in the extended position, the pivot post 38 nests in the lower radius 66 and, in cooperation with the spring 52, urges the tumbler longitudinally upwardly so that an upper end 76 of the tumbler engages an inner surface 78 of the end wall 44 and a rear bevel 80 of the tumbler engages the back wall 58 of the housing 24. The protrusion 70 resists downward longitudinal movement of the tumbler 32 to retain the pivot post 38 in the lower radius 66.

The pivot bore and pivot post could have other configurations including posts on the tumbler received in suitably shaped recesses or apertures in the housing. Different cooperating contours of the pivot bore and pivot post may also suitably urge the tumbler into engagement with the housing and limit rotation of the tumbler. For example, the recesses and pivot post need not be circular or rounded.

In operation, the sash lock 22 is normally in the retracted position shown in FIG. 2. The spring 52 biases the nose 60 against the inner flange 64 to retain the tumbler 32 inside the housing 24. The pivot post 38 nests in the upper radius 68. To limit upward movement of the lower sash 14, the operator slides the tumbler 32 upwardly, with the aid of the ridges 62, until the nose 60 clears the inner flange 64 and the pivot post 38 is substantially past the protrusion 70. The spring 52 then moves the tumbler 32 to the extended position. When the nose 60 engages the header rail 16, the pivot post 38, back wall 58 and end wall 44 prevent rotation of the tumbler 32 to limit movement of the lower sash 14. The protrusion 70 resists slipping of the pivot post 38 into the upper radius 68 thereby preventing over-rotation of the tumbler 32. The sash lock 22 is returned to the retracted position by pushing the tumbler 32 into the housing 24 and sliding the tumbler downwardly until the nose 60 engages behind the inner flange 64.

All of the parts of the sash lock 22, except the spring 52, are preferably molded from plastic. The tumbler 32 can be provided with a notch, on a back wall, for example, to permit tunnel gating without leaving flashing that might interfere with operation. The spring 52 is preferably made of a durable, resilient material, such as steel or plastic.

The present disclosure describes several embodiments of the invention, however, the invention is not limited to these embodiments. Other variations are contemplated to be within the spirit and scope of the invention and appended claims.

What is claimed is:

1. A sash lock, comprising:

a housing defining a cavity;

a tumbler disposed in the cavity and pivotably mounted so as to permit pivoting movement of the tumbler between a retracted position in the housing and an extended position projecting from the housing;

means for biasing the tumbler toward the extended position;

a pivot post on which the tumbler is pivotably mounted; and an eccentric pivot bore into which the pivot post extends, said pivot bore and pivot post cooperating with the biasing means to urge the tumbler into engagement with the housing in the extended position thereby limiting rotation of the tumbler, wherein said pivot bore has a protrusion resisting longitudinal movement of the tumbler in the extended position.

2. A sash lock according to claim 1, wherein the tumbler has a nose, said nose projecting from the housing in the extended position and adapted to engage a window sash.

3. A sash lock according to claim 1, wherein the tumbler includes a surface adapted for engaging a back wall of the housing in the extended position.

4. A sash lock according to claim 1, wherein the pivot bore includes upper and lower recesses separated by the protrusion, said pivot post nesting in the lower recess in the extended position.

5. A sash lock according to claim 4, wherein the lower recess has a radius corresponding to a radius of the pivot post.

6. A sash lock according to claim 1, wherein the protrusion engages the pivot post.

7. A sash lock according to claim 1, wherein the means for biasing the tumbler toward the extended position comprises a spring.

8. A sash lock according to claim 7, further comprising a channel in the tumbler in which the spring is mounted.

9. A sash lock according to claim 8, further comprising a keeper for retaining the spring in the channel.

10. A sash lock, comprising:

a housing defining a cavity and having a post disposed therein;

a tumbler having a sash engaging nose, said tumbler having an eccentric pivot bore therethrough and being disposed in the cavity and pivotably mounted on the post so as to permit pivoting movement of the tumbler between a retracted position in the housing and an extended position wherein said nose projects from the housing;

a spring for urging the tumbler toward the extended position; and a protrusion defined by the bore, said protrusion being engageable with the post and cooperating with the spring to urge the tumbler longitudinally into engagement with the housing in the extended position.

11. A sash lock according to claim 10, wherein the protrusion separates upper and lower recesses of the bore and the protrusion retains the post in the lower recess in the extended position.

12. A sash lock according to claim 10, wherein an end of the tumbler engages a back wall of the housing and cooperates with the pivot post to limit rotation of the tumbler in the extended position.

13. A sash lock according to claim 12, wherein the end of the tumbler includes a bevel.

14. A sash lock according to claim 10, further comprising a cover mountable on the housing and having the pivot post extending therefrom.

15. A window assembly in combination with a sash lock having an upper sash and a lower sash, each having a header rail, a base rail, and a pair of stiles; and the sash lock disposed in one of the stiles of the upper sash, said sash lock comprising:

a housing defining a cavity and having a post disposed therein;

a tumbler having a nose positioned to engage an upper surface of the header rail of the lower sash, said tumbler having an eccentric pivot bore therethrough and being disposed in the cavity and pivotably mounted on the post so as to permit pivoting movement of the tumbler between a retracted position in the housing and an extended position wherein said nose projects from the housing;

a spring for urging the tumbler toward the extended position; and a protrusion defined by the bore, said protrusion being engageable with the post and cooperating with the spring to urge the tumbler longitudinally into engagement with the housing in the extended position.

* * * * *